US011236747B2

(12) United States Patent
Hauck et al.

(10) Patent No.: US 11,236,747 B2
(45) Date of Patent: Feb. 1, 2022

(54) ECCENTRIC SCREW PUMP

(71) Applicant: NETZSCH Pumpen & Systeme GmbH, Selb (DE)

(72) Inventors: Josef Hauck, Mengkofen (DE); Hisham Kamal, Waldkraiburg (DE); Reinhard Denk, Mühldorf (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 181 days.

(21) Appl. No.: 16/604,497

(22) PCT Filed: Apr. 10, 2018

(86) PCT No.: PCT/DE2018/100322
§ 371 (c)(1),
(2) Date: Oct. 10, 2019

(87) PCT Pub. No.: WO2018/188694
PCT Pub. Date: Oct. 18, 2018

(65) Prior Publication Data

US 2020/0056609 A1 Feb. 20, 2020

(30) Foreign Application Priority Data

Apr. 12, 2017 (DE) ..... 102017107962.9

(51) Int. Cl.
*F01C 1/10* (2006.01)
*F03C 2/00* (2006.01)
(Continued)

(52) U.S. Cl.
CPC ..... *F04C 15/0065* (2013.01); *F04C 2/1076* (2013.01); *F04C 15/0007* (2013.01); *F04C 2240/40* (2013.01); *F05C 2225/04* (2013.01)

(58) Field of Classification Search
CPC .... F04C 2/1071; F04C 2/1075; F04C 2/1076; F04C 15/0007; F04C 15/0073;
(Continued)

(56) References Cited

U.S. PATENT DOCUMENTS 2,545,604 A * 3/1951 Frederick ..... F04C 2/1073 418/48
2,612,845 A * 10/1952 Frederick ..... F04C 2/1073 418/48
(Continued)

FOREIGN PATENT DOCUMENTS

DE 2139949 A1 3/1972
DE 2316127 A1 10/1974
DE 102016009028 A1 2/2018

OTHER PUBLICATIONS

International Search Report, Written Opinion of the International Searching Authority, and Translation. Application No. PCT/DE2018/100322 Completed: Jul. 24, 2018; dated Sep. 13, 2018 11 pages.

*Primary Examiner* — Theresa Trieu
(74) *Attorney, Agent, or Firm* — Whitmyer IP Group LLC

(57) ABSTRACT

An eccentric screw pump for pumping fluids or flowing conveying media from a suction side to a pressure side, which includes a rotor and a stator, the stator being flexible and is connected to the pump housing on one side, in particular on the suction side. The rotor is connected to the drive shaft by means of an articulation. When the eccentric screw pump is in the idle state, there is no sealing contact at least in areas between the rotor and the stator in the sealing areas. When the eccentric screw pump is in the operating state, the stator is surrounded, at least in sections and/or, essentially, on the periphery by the conveying medium. The rotor and the stator are brought into contact with each other in the operating state along the sealing area.

19 Claims, 5 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 2/107*** | (2006.01) |

(58) Field of Classification Search
CPC ..... F04C 15/0065; F04C 2240/40; F05C 2225/00; F05C 2225/04
See application file for complete search history.

(56) References Cited

U.S. PATENT DOCUMENTS

| | | | | |
|---|---|---|---|---|
| 2,733,854 | A * | 2/1956 | Chang | F04C 18/1075 418/48 |
| 2,765,114 | A | 10/1956 | Chang | |
| 2,826,152 | A | 3/1958 | Michie | |
| 6,336,796 | B1 * | 1/2002 | Cholet | F04C 2/1075 418/48 |
| 2006/0124298 | A1 * | 6/2006 | Geier | E21B 43/12 166/369 |
| 2015/0322946 | A1 * | 11/2015 | Krampe | F04C 2/1075 418/48 |
| 2019/0299164 | A1 * | 10/2019 | Khalifa | B01D 61/364 |

* cited by examiner

ECCENTRIC SCREW PUMP

TECHNICAL FIELD

The present invention relates to an eccentric screw pump, in particular a wobble pump, for pumping fluid or free-flowing conveying media from a suction side to a pressure side.

BACKGROUND

Eccentric screw pumps are pumps for conveying a plurality of media, in particular viscous, highly viscous and abrasive media, such as, for example, sludge, slurry, crude oil and grease. Eccentric screw pumps known from the prior art are composed for a rotor and a stator, wherein the rotor is accommodated in the stator and moves eccentrically in the stator. For this purpose, the stator has a helically coiled inner side. Conveying chambers, by means of which liquid media can be transported along the stator, are formed from the movement of the rotor and mutual contact of stator in rotor in so-called sealing areas or sealing contact surfaces, respectively. The rotor thereby performs an eccentrical rotational movement around the longitudinal stator axis or around the longitudinal axis of the eccentric screw pump, respectively. The outer screw, that is, the stator, has the shape of a double thread, for example, while the rotor screw is only single thread. Eccentric screw pumps are suitable, for example, for conveying water, crude oils and a plurality of further liquids. The shape of the conveying chambers is constant in response to the movement of the rotor within the stator, so that the conveying medium is not squeezed. In the case of a suitable design, eccentric screw pumps cannot only convey fluids, but also solids.

The conveying efficiency of an eccentric screw pump is determined especially by the quality of the seal between the pressure chambers or conveying chambers, respectively, of the stator, and the profile of the displacing rotor, which is attained in particular in that the pressure chamber walls of the stator are pressed elastically against the rotor by means of a prestress in the sealing areas or in the area of the sealing contact surfaces, respectively. This initial coverage is necessary in particular to prevent that the pumping pressure, which builds up when starting the eccentric screw pump, pushes the elastically deformable material of the stator radially to the outside. If this coverage is not present, the frictional contact between the rotor and the stator is lost due to the pump pressure, which builds up. Said frictional contact is necessary, however, to prevent or to minimize, respectively, an overflowing of the conveying medium to a conveying chamber with lower pressure. Coverage is in particular understood in such a way that the outer dimensions of the rotor in the contact areas or along the sealing areas, respectively, or sealing contact surfaces, respectively, between rotor and stator are larger than the internal dimensions of the stator.

A plurality of eccentric screw pumps is known, which have an unreinforced elastomeric stator. For the most part, these are eccentric screw pumps, in the case of which the stator is surrounded by a pressure medium. In the case of such eccentric pumps, a stator end is secured, for example, within the eccentric screw pump, while the other stator end is arranged so as to oscillate freely. The stator is thus able to absorb the eccentric movement of the rotor-stator system. It is furthermore provided that the stator is surrounded by the conveying medium. In the case of this pump type, the conveying direction is in particular chosen in such a way that the conveying medium surrounding the stator has the pressure side pressure of the eccentric screw pump. Due to the resulting pressure difference between the conveying chambers, which are connected to the suction side, and the pressure side pressure on the outer jacket surface of the stator, the stator is pushed onto the rotor. Comparatively high pressures can thus also be generated by means of very soft stators. These eccentric screw pumps are in particular identified as wobble pumps.

There are two types of wobble pumps. The first ones are designed with joint, and the second ones without joint. In the case of wobble pumps without joint, the axis of the flexible rubber stator describes a cylindrical shape, i.e. the stator is pushed away to the side. In the case of wobble pumps with joint, the eccentric movement between rotor and stator (eccentricity) is compensated in that a cardan joint is arranged between the stationary axis of the drive shaft and the rotor screw for torque transmission. In addition, the stator is flexibly clamped on the opposite end, which allows for a further cardanic degree of freedom. Due to the distance of these two cardanic degrees of freedom, each with the angle $\alpha$, the eccentricity e can be compensated. The axis of the stator essentially describes a conical shape.

It is in particular a disadvantage that due to the contact of rotor and stator with coverage along the sealing areas or sealing contact surfaces, respectively, a high breakaway torque has to be overcome when starting the eccentric screw pump. The used drive for the rotor has to be dimensioned sufficiently in order to exert the corresponding force for the breakaway of the eccentric screw pump and the acceleration of the eccentric screw pump across the low speed range.

SUMMARY

It is the object of the invention to provide an eccentric screw pump, in particular a wobble pump, the start-up of which is improved during commissioning.

The above object is solved by means of an eccentric screw pump, in particular a wobble pump, which comprises the features described in the independent claims. Further advantageous embodiments are described by the subclaims.

The invention relates to an eccentric screw pump, in particular a wobble pump, for pumping fluid or free-flowing conveying media from a suction side to a pressure side. The wobble pump comprises an inner pump part and an outer pump part, for example the wobble pump comprises a rotor as inner pump part and a stator as outer pump part, in particular a wobble stator. According to an alternative embodiment, it can also be provided that the outer pump part is arranged such that it rotates, while the inner pump part is secured. A further embodiment can provide that the inner and the outer pump part are arranged so as to counter-rotate.

According to the preferred embodiment, the eccentric screw pump comprises a rotor and a stator. The rotor of the wobble pump is connected to a drive shaft via a joint, and thus to the drive. Alternatively, the joint can also be connected directly to the motor shaft of the drive. The stator is designed to be flexible and is fixed to the housing of the eccentric screw pump or pump housing, respectively, on one side, in particular on the suction side, while the other stator end is arranged within the pump housing to as to oscillate freely and can thus absorb the eccentric movement of the rotor. Only the term wobble pumps will preferably be used below to describe such an eccentric screw pump.

The stator is preferably designed to be flexible, it can consist, for example, of an elastomer material. Alternatively, it can be provided that even though the stator consists of a relatively rigid material, the latter is designed to be thin-walled to such an extent that the material of the stator yields accordingly, in particular in the case of a force acting radially to the longitudinal axis of the stator.

During ongoing production, the stator and the rotor of the wobble pump are brought into contact along so-called sealing lines or sealing areas, so that conveying chambers, which are separated from one another, are formed for the conveying medium. In an idle state of the wobble pump, in contrast, there is no sealing contact at least in some areas between the rotor and the stator in the sealing areas or in the area of the sealing contact surfaces, respectively. In an operating state of the wobble pump or operating mode of the wobble pump, respectively, the stator, which will also be referred to as wobble stator below, in contrast, is surrounded at least in some areas and/or essentially completely by the conveying medium. Said conveying medium effects a pressure on the outer jacket surface of the stator. The stator is pushed radially against the rotor and is brought into sealing contact therewith, in particular in the sealing areas or in the area of the sealing contact surfaces, respectively, whereby adjacent conveying chambers for the conveying medium, which are separated from one another, are formed.

Further advantageous embodiments of the wobble pump will be described below by means of a wobble pump, in the case of the outer pump part is formed as wobble stator and the inner pump part as rotor. It goes without saying that the person of skill in the art can transfer this analogously to wobble pumps, which have a static inner pump part and a rotating outer pump part, or to wobble pumps, in the case of which inner and outer pump part are formed so as to counter-rotate.

It is preferably provided that in the idle state of the wobble pump, a play is formed at least in some areas between the rotor and the stator along the sealing areas or sealing contact surfaces, respectively.

The flexible area of the wobble stator, which is responsible for the compensation of the eccentricity, is one of the most highly stressed points of the wobble stator. Due to the ongoing deflection of the wobble stator, tensile or compressive forces, respectively, or shear forces are created in this area, depending on the design of the stator clamping point. The operating torque and the axial force due to the differential pressure can also cause tensile, compressive or shear forces once again, depending on the design of the stator clamping point. High shear stresses are created on the wobble stator due to the drive torque. It is known that elastomers can withstand tensile and shear forces for a long time, if the elastomer material is "prestressed" or if compressive stresses are introduced, respectively. It is furthermore known that the drive torque and shear stresses resulting therefrom increase as the conveying pressure of the pump becomes larger. In addition to the mentioned stresses on the flexible area of the wobble stator, compressive forces caused by the differential pressure between pressure and suction side are generated during the operation of the wobble pump, which is clamped directly on the end side, with average and high pressures. These compressive forces serve as "prestressing" of the material, so that long service lives can be attained in this operating state.

If wobble pumps according to the prior art comprising a coverage between rotor and wobble stator are operated at low pressures or in a pressureless state, this overlapped "prestressing" is missing, so that the elastomer material of the wobble stator is damaged. In particular in response to the start-up of wobble pumps comprising a coverage between rotor and wobble stator, this leads to a particularly strong material damage, because the breakaway torque has to be tolerated completely without "prestressing".

The eccentric screw pump according to the invention comprising wobble stator and comprising play formed at least in some areas between the wobble stator and the rotor in the idle state, thus has flexible areas in the wobble stator, which, in the case of higher torque loads, have a higher matching prestressing. Due to the play, the starting torque is approximately zero and the operating torque is also very low in the case of small differential pressures.

It is provided, for example, that at least in some areas, the rotor has outer dimensions, which are smaller than the internal dimensions of the wobble stator. Between rotor and wobble stator largely within the entire area of the sealing areas or sealing contact surfaces, respectively, which separate the conveying chambers from one another, thus in the idle state, there is in each case preferably at least a minimal distance between the rotor and the wobble stator.

According to a preferred embodiment of the invention, no sealing contact is formed between the rotor and the wobble stator in the idle state along an area, which corresponds approximately to between 50%-100% of the sealing areas or sealing contact surfaces, respectively. In this area, a play or distance, respectively, is in particular formed between the rotor and the wobble stator. In the remaining areas, a contact between the rotor and the wobble stator can optionally exist in the sealing areas or in the area of the sealing contact surfaces, respectively. It is even possible that a coverage between the rotor and the wobble stator is present in part in the remaining 0% to 50% of the sealing areas or sealing contact surfaces, respectively. This means that it would also be conceivable that in the case of an embodiment of a wobble pump according to the present application, a play or distance, respectively, is formed and a coverage is formed in some areas between the rotor and the wobble stator of the rotor-stator system between the rotor and the wobble stator in the sealing areas or in the area of the sealing contact surfaces, respectively. This can be created in particular due to the production tolerances in response to the production of the rotor and/or of the wobble stator.

Between the rotor and the wobble stator, there is a contact between the rotor and the wobble stator along the sealing areas or sealing contact surfaces, respectively, in the operating state. This contact is created in particular by means of the conveying medium, which acts on the outer jacket surface of the wobble stator. This is also referred to as overlapping, because the conveying medium, which acts on the outer jacket surface from the outside, compresses the flexible wobble stator in such a way that it wants to take a shape, the internal dimensions of which would be smaller than the outer dimension of the rotor. A contact, in particular a frictional contact between the rotor and the wobble stator is established at least in some areas, preferably along the complete total length of the sealing areas or sealing contact surfaces, respectively, by means of the overlapping. This frictional contact effects a physical separation of adjacent conveying chambers of the eccentric screw pump, whereby a return flow of the conveying medium can be effectively prevented.

In an operating state, the wobble pump has a suction side comprising a suction side pressure. The conveying medium reaches into the wobble pump via an inlet, and is conveyed to the pressure side through the conveying chambers between the wobble stator and the rotor. Within the wobble pump, a first suction side pressure exists on the suction side, and a second pressure side pressure on the pressure side.

If the conveying medium is transported through the wobble pump, pressure is increasingly built up from the suction side in the direction of the pressure side. Conveying chambers, which, depending on the current angle of rotation between the rotor and the wobble stator, either essentially have the suction pressure or the pumping pressure of the wobble pump, are in particular created in response to the pumping of the conveying medium within the rotor-stator system. In the case of a single-stage wobble pump, conveying chambers can be seen in a snapshot, which have the suction side pressure, and other conveying chambers, which have the pressure side pressure. In the case of rotor-stator systems comprising more than one stage, completely closed conveying chambers also exist additionally, which have a pressure value between the suction side pressure and the pressure side pressure. This means that there is no pressure difference between stator interior and stator exterior in the pressure side area of the wobble stator up to a large portion of the angle of rotation. In contrast, there is a pressure difference between interior and exterior of the wobble stator in the suction side area up to a large portion of the angle of rotation.

The stator is pushed to the outside due to the pressure differences between the conveying chambers; the conveying medium quasi attempts to push the stator to the outside, in order to be able to flow into a conveying chamber with a lower pressure. This outwardly-directed pressure is approximately identical all over the stator. This pressure, which is directed radially to the outside, within the conveying chamber has the effect that the elastomeric wobble stator is pushed radially to the outside. To compensate the play, which exists between the rotor and the wobble stator in the idle state, and to prevent that the pressure, which is directed radially to the outside creates a distance within the conveying chambers in the sealing areas or in the area of the sealing contact surfaces, respectively, between the rotor and the wobble stator, which distance allows for a pass-over of conveying medium between the individual conveying chambers, and which would thus provide for a return flow of conveying medium to the suction side, the pressure side pressure of the conveying medium applies to the outer jacket surface of the stator during the operation of the wobble pump—as already described. The outer pressure is thus applied by means of the conveying medium, which is conveyed towards the pressure side and which flushes around the free end of the wobble stator, which is arranged freely within the pump housing, with the pressure side pressure and thus effects a radial pressing of the stator against the rotor, and a sealing contact between the stator and the rotor in the area of the sealing contact surfaces.

According to an embodiment of the invention, it is provided that a first play is formed between the rotor and the wobble stator in the idle state of the wobble pump, and that a second play is formed between the rotor and the wobble stator on the pressure side. The first play on the suction side is in particular larger than the second play on the pressure side. In the idle state, no differential pressure is applied between the suction side and the pressure side via the wobble pump.

Due to the fact that the inner pressure of the conveying medium increases towards the pressure side, while the outer pressure of the pressure medium on the outer jacket surface of the wobble stator is essentially identical all over, the wobble stator is pressed against the rotor less strongly in the area of the pressure side than on the suction side. In the case of an embodiment, in which a smaller play between the rotor and the wobble stator is formed on the pressure side than on the suction side in the idle state, this can accordingly be compensated better, so that the frictional contact between the wobble stator and the rotor along the sealing areas or sealing contact surfaces, respectively, is essentially identical all over. The geometry of the rotor and/or of the wobble stator is thus chosen in such a way that the prestress between the rotor and the wobble stator on the suction side is reduced as compared to the pressure side.

For example, the play between rotor and wobble stator can decrease essentially continuously along the sealing areas or sealing contact surfaces, respectively, between the rotor and the wobble stator from the suction side to the pressure side, so as to compensate the pressure difference which rises from the suction side to the pressure side.

According to a further embodiment, it can be provided that, in the idle state of the wobble pump, a play is formed between the rotor and the wobble stator on the suction side, and that a so-called coverage between the rotor and the wobble stator is provided on the pressure side.

In the idle state, in particular before the start of a pumping process, no conveying medium is present on the pressure side of the wobble pump, or the present medium has only a small differential pressure to the suction side of the wobble pump, respectively. A corresponding pressure thus also does not act on the outer jacket surface of the wobble stator. At the start of the pumping process, conveying medium is conveyed towards the pressure side of the wobble pump, which conveying medium then pushes against the outer jacket surfaces of the wobble stator and thus effects the desired overlapping or contact, respectively, between the rotor and the wobble stator in the sealing areas or in the area of the sealing contact surfaces, respectively, so that the respective adjacent conveying chambers are physically separated from one another.

Due to the fact that an outer pressure does not yet act on the outer jacket surface of the wobble stator at the beginning of the pumping process, and a play thus essentially exists between the rotor and the wobble stator, such a wobble pump does not have a or only a very small breakaway torque, respectively, so that such a wobble pump, compared to conventionally known wobble pumps, in the case of which a coverage is formed between rotor and stator in the idle state, can be operated with a weaker drive.

According to an embodiment of the invention, an annular chamber, into which the conveying medium flows, is formed at least in some areas between the wobble stator and the pump housing on the pressure side. The conveying medium located in the annular chamber thus pushes with pressure side pressure against the outer jacket surface of the wobble stator.

Eccentric screw pumps comprising stators, which are clamped on both sides and in which conveying medium is used to generate a sufficient pressing pressure between stator and rotor during operation, are already known. A dead space is thereby formed in the supply line of the conveying medium to the stator and around the stator. In particular in the case of conveying media, which contain solid particles, impurities, or the like, deposits can occur within these dead spaces, which then block and/or destroy the corresponding components within a relatively short period of time.

What is furthermore described are eccentric screw pumps comprising stators, which are clamped on both sides, which use a pressure transfer medium, wherein the conveying medium on the pressure side and the pressure transfer medium surrounding the stator are separated by a piston or a membrane. This results in the disadvantage, however, that a significantly more complicated setup is at hand here. In addition, a displaceable piston can also be blocked and/or destroyed by means of solid bodies. The same applies for flexible membranes. The mentioned problem does not exist in the case of a wobble pump, because the free end of the wobble stator is arranged so as to oscillate freely within the conveying medium of the pressure side here.

In general: the larger the pressure, which is to be conveyed, of an eccentric screw pump, the higher the pressing forces have to be between rotor and stator, in order to ensure a sufficient of the eccentric screw pump. At the same time, these pressing forces are to not become too large, however, so as to avoid unnecessary power dissipation and wear caused by friction.

The prior art already provides a solution here, whereby the pressing force between rotor and a stator, which is clamped on two sides, can be adapted to the differential pressure. However, the differential pressure between the fluid on the pressure side and the stator interior is not identical all over. At the pressure-side area of the stator, which is clamped on two sides, the pressure in the interior of the stator, which is clamped on two sides, and the surrounding pressure of the fluid on the pressure side is approximately identical. In the suction-side area of the stator, which is clamped on two sides, essentially the suction pressure is present in the interior of the stator, thus resulting in a very high pressure difference as compared to the fluid on the pressure side. Due to the clamping of the stator on two sides in the pressure- and suction-side area of the stator, said stator is stabilized from both sides and the radial flexibility of the stator is in each case limited in this area. The course of differential pressure and radial stability of the stator results in a pressing force. The latter is highly irregular for stators, which are clamped on both sides, which leads to an inferior efficiency and to increased, in particular punctual wear.

In the case of wobble pumps comprising a stator, which is clamped on one side, the stator's ability to move is limited on one side. The stator is clamped in particular on the suction-side end and can be moved to a limited extent in this area. On the pressure-side end, in contrast, the wobble stator can be moved radially without limitation. When calculating the pressing force as function of differential pressure radial stability, a pressing of the wobble stator against the rotor, which is even across large areas of the stator length, results due to an advantageous distribution of the pressing forces.

The one-sided clamping of the stator takes place on the end side, for example directly via an annular widening formed on the free end of the stator. In the alternative, a flange, which serves to fasten the stator to the pump housing, can be formed, starting at the free end area. The pressure difference of the wobble pump during operation results in a high axial force on the stator opposite the conveying direction, i.e. directed away from the drive of the rotor. In the case of the end-side, one-sided clamping, in particular in the case of direct end-side clamping or end-side clamping with flange, a compressive stress is created in the elastomer at the highly stressed bending point due to the axial force. Said compressive stress is advantageous for the service life of the stator material. In contrast to known wobble stators comprising coverage, the clamping point of the wobble stator is stressed less strongly in the case of the wobble pump according to the invention, because the torque is only applied, when a pressive stress is also formed in an overlapping manner.

The speed of wobble stators is generally limited. Wobble stators can in particular only be operated with lower speeds, because strong oscillations are created in the case of excessive speed, which oscillations can damage parts of the wobble pump. It has been demonstrably determined that smaller oscillations are created due to play between rotor and wobble stator. A wobble pump according to the invention can thus be operated at higher speeds than conventionally known wobble pumps. This advantageous reduction of the oscillations results from the smaller drive torques due to the play formed between rotor and wobble stator, because the system, which is able to oscillate, is excited less strongly in the rotational direction. In particular in the case of speed-variable pumps with predetermined power, such as, for example, solar pumps, only small differential pressures can still be overcome. This means that only a small drive torque is present in the case of wobble pumps comprising a play formed between rotor and wobble stator in the idle state. The excitation of the system, which is able to oscillate, is thus once again lower.

The advantage of a wobble stator with play to the rotor described here also lies in that such a wobble stator can be formed to be shorter than a stator, which is clamped on two sides. Due to the fact that the second clamping point is dispensed with, inlet side and pressure connection can be accommodated in the same installation space of the pump housing, the pressure connection can in particular be formed at least partially in the stator area.

It is further advantageous that such a wobble pump can be assembled without expenditure of force, because in contrast to the rotor-stator systems comprising coverage, the rotor can be inserted into the internal thread of the wobble stator largely without friction.

According to an embodiment, the wobble stator can have a helical outer contour, which corresponds in particular to the helical inner contour. Such a wobble stator can be produced more cost-efficiently, because less material is required, and the vulcanization time is shortened due to the smaller wall thickness, so that the production takes place more quickly and more stators can thus be produced within a defined period of time. In addition, the stability of such a wobble stator is more even in the circumferential direction.

A joint for a wobble pump is further described, which comprises a reinforced elastomer part. Various articulated shafts for eccentric screw pumps in the form of fiber- or wire-reinforced plastic or elastomer bodies are known. They serve to compensate the eccentric movement between a stationary stator and a stationary drive shaft. In the case of the embodiments of joints known from the prior art, it is disadvantageous that a large flexible length is required for the compensation of the axial offset. There is thus the tendency of lateral oscillations in the case of higher speeds. These oscillations reduce the service life of the joint and lead to unwanted noise development and damaging vibrations. Moreover, an inner support construction in the form of a shaft, a pipe, a spring, or a granulate, is necessary to transfer noteworthy compressive forces (in the case of conveying direction away from the motor). All of these support constructions lead to unwanted friction and wear in and/or on the joints.

If the joint, which will be described in more detail below, is used in connection with a wobble pump, only an angle $\alpha$ instead of an axial offset e has to be compensated. Tests have shown that between 0.5 and 1.5-times the outer diameter is already sufficient as free bending length in order to compensate an angular offset of between 1° and 2°, which is common in wobble pumps. Fewer oscillations are created due to this short length of the joint, which also leads to an increased efficiency, longer service life of the components, and higher possible maximum speeds.

For particularly high stresses, the advantageous oscillation properties and the ability to transfer compressive forces of the short joint bodies, which are only stressed with angular deflection, can be combined with the inner support bodies known from the prior art or with additional outer support bodies. For example a ball, granulate, a helical spring, a cylindrical shaft piece or a flexible elastomer or plastic body, respectively, can thereby be used as support bodies. The combination of support body with a lubricant is recommended here. In addition, a more or less viscous supporting liquid can also be used.

The joint comprises a central part, which is formed so as to be at least partially movable and which is made of a reinforced elastomer or plastic material. The reinforcement of the elastomer or plastic material is preferably formed by means of a fiber reinforcement or wire reinforcement integrated in the material. According to an embodiment, the actual joint body consists of a commercially available hydraulic hose or of another suitable hose comprising an inner reinforced structure. The hose or hydraulic hose, respectively, consists, for example, of a flexible material, for example elastomer, or the like, which is reinforced with reinforcements, which are preferably interlaced in a cross-shaped manner, in one or a plurality of layers. The reinforcement can thereby consist of steel, of plastic fibers, as well as of textile fibers.

The central piece is limited on both sides by connecting pieces for fastening the rotor and/or the drive shaft. According to an embodiment, a connecting piece is in each case fastened to the two free ends of the hose piece. The two connecting pieces are preferably formed with retaining grooves in the axial direction and/or possibly also in the radial direction. The connecting pieces preferably have an n-edged area, wherein n corresponds to the number of the jaws on the subsequently used hose press (hose presses usually have six or eight jaws). The connecting pieces each comprise, for example, a sleeve for retaining the respective end of the hose piece. The sleeves are compressed with the help of a hose press, so that the hose is fixed between the two connecting pieces. The n-edged area on the connecting piece is to thereby be oriented so as to be angular with the jaws of the hose press. After the pressing, a reliable connection is created between the respective connecting piece and the respective sleeve, and thus also a reliable connection between the respective connecting piece and the respective free end of the hose piece.

In the alternative, a cylindrical area, which is formed so as to be thin, can also be used instead of an n-edged area on the connecting piece. In response to the pressing process, this thin area can then also be brought into the n-edged shaped.

At least two sleeves are preferably pressed simultaneously in a suitable jaw construction. A higher torque can be allowed for the construction due to the n-edged pressing between sleeve and connecting piece, because a relative movement between hose and sleeve as well as between hose and connecting piece has to take place simultaneously for a slipping of the hose. The n-edged shape on the outer side can also be used as contact surface for tools, when for example detachable threads are used as connection to the adjacent parts.

To protect the free ends of the hose piece, for example against environmental influences, such as penetrating fluid or the like, and/or to reinforce the bond between hose and sleeve or hose and connecting piece, respectively, a sealing and/or adhesive mass can additionally be used, which is introduced in particular between the free ends of the hose piece and the respective sleeve.

An alternative embodiment can provide to utilize commercially available metallic inserts for injection molded parts instead of the two connecting pieces or in combination with a connecting piece. The n-edged connection between connecting piece and sleeve can possible be forgone here. In the case of an embodiment, threaded pins can be used here to provide external threads.

When using a joint between the rotor and the drive, it is an advantage that the rotor can be positioned within the stator in such a way that the play between stator and rotor along the pressure areas is identical all over.

A further embodiment of a wobble pump can provide that the rotor-stator system has an inlet-side end portion, in which a sealing line-free inlet funnel is formed between the stator and the rotor along a funnel length, wherein the screw thread-shaped inner circumferential surface of the stator is formed in a central main portion of the rotor-stator system and in the inlet-side end portion. The inlet funnel is in particular formed in the manner, as it is described in the application with file number DE 10 2016 009 028, the content of which is hereby added into this application. Such an inlet funnel, which comprises a continuation of the screw thread-shaped inner circumferential surface of the stator on the one hand and which is sealing line free on the other hand, attains advantageous flow effects.

According to an embodiment, the invention thus relates to eccentric screw pumps comprising an unreinforced elastomeric stator, wherein the conveying medium surrounding the stator serves as pressure medium to establish the sealing contact between rotor and stator during the pump operation. If applicable, the stator can also be supported by using a largely rigid material, whereby the flexible one-sided clamping point has to be maintained.

A certain differential pressure is in particular created when starting the wobble pump, as a result of which the wobble stator is pushed onto the rotor by means of the conveying medium, which acts on the wobble stator from the outside with pressure side pressure, whereby an actual separation of the pressure side from the suction side of the wobble pump is generated by means of the forced solid body contact between the rotor and the stator. This provides various advantages. On the one hand, the breakaway of a wobble pump according to the invention comprising a gap between stator and rotor is easily possible, because a differential pressure is not yet applied during standstill of the wobble pump. The differential pressure between the inner space and the outer space of the wobble stator only builds up as the speed increases, and thus closes the sealing contact at so-called sealing areas or sealing contact surfaces, respectively.

Due to the fact that in the case of wobble pumps known from the prior art comprising a coverage, in the case of which the stator is also surrounded by conveying medium during operation, the friction torques are significantly higher in the case of speeds below the operating range, which is common for the corresponding wobble pump, correspondingly strong drives are necessary for the start-up of such wobble pumps. A wobble pump according to the invention with play between rotor and stator, in contrast, can be operated with a significantly smaller drive. One reason for this is that the differential pressures, which lead to excessive torques, cannot be built up in the case of low speeds. This means that, due to the play or distance, respectively, formed at least in some areas between rotor and wobble stator, the necessary drive moment in the case of the wobble pumps according to the invention is significantly smaller than in the case of wobble pumps comprising a coverage between the rotor and the wobble stator. In the case of a wobble pump according to the invention, an improvement of the efficiency or of the total efficiency, respectively, furthermore results in a large part of the characteristic pump diagram.

The wobble pump according to the invention can thus be used in an advantageous manner as photovoltaically operated water pump. The breakaway of the wobble pump and the acceleration of the wobble pump across the low speed range are thereby critical, because the available motor torque is lower as compared to net-coupled pumps. The available amount of energy and thus drive force is also a function of the provided amount of light and/or the angle of incidence of the solar radiation. The position of the sun in particular plays an important role. The solar radiation, which is still weak in the morning and which impinges highly obliquely on the photovoltaic panels, provides little energy, which once again leads to a reduced motor torque.

BRIEF DESCRIPTION OF THE DRAWINGS

Exemplary embodiments of the invention and their advantages will be described in more detail below on the basis of the enclosed figures. The size ratios of the individual elements relative to one another in the figures do not always correspond to the actual size ratios, because some shapes are illustrated in a simplified manner, and other shapes are illustrated in an enlarged manner as compared to other elements for illustrative purposes.

DETAILED DESCRIPTION

Figure 1:
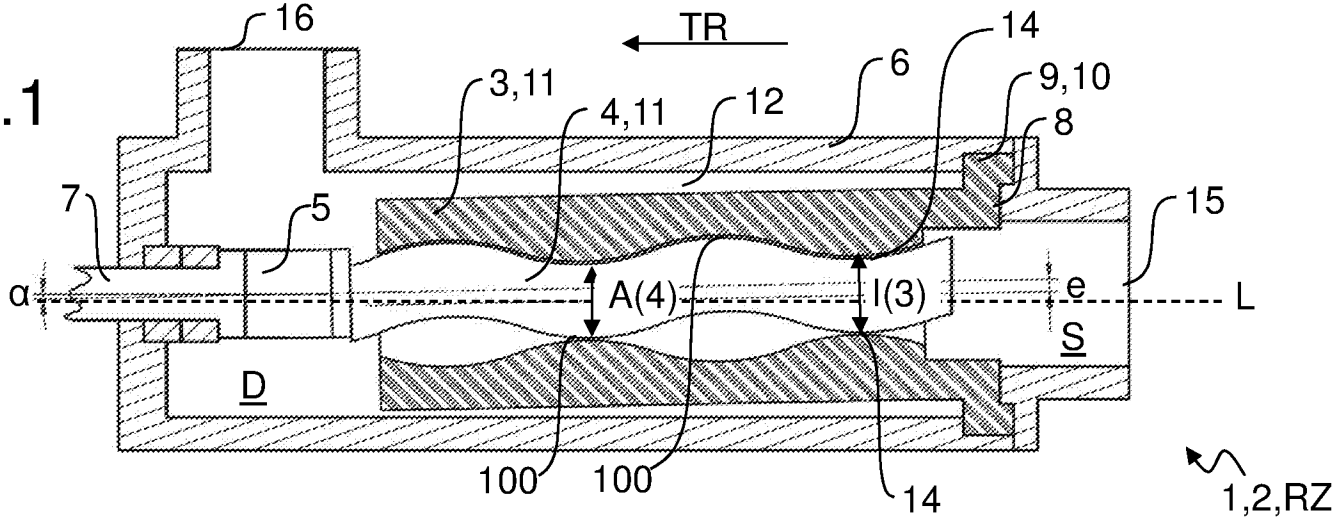
FIG. 1 shows an eccentric screw pump according to the invention in an idle state.

Identical reference numerals are used for identical elements of the invention or for elements having identical effects. For the sake of clarity, only reference numerals, which are required for the description of the respective figure, are further illustrated in the individual figures. The illustrated embodiments only represent examples for how the device according to the invention can be designed, and do not represent a final limitation.

Figure 2:
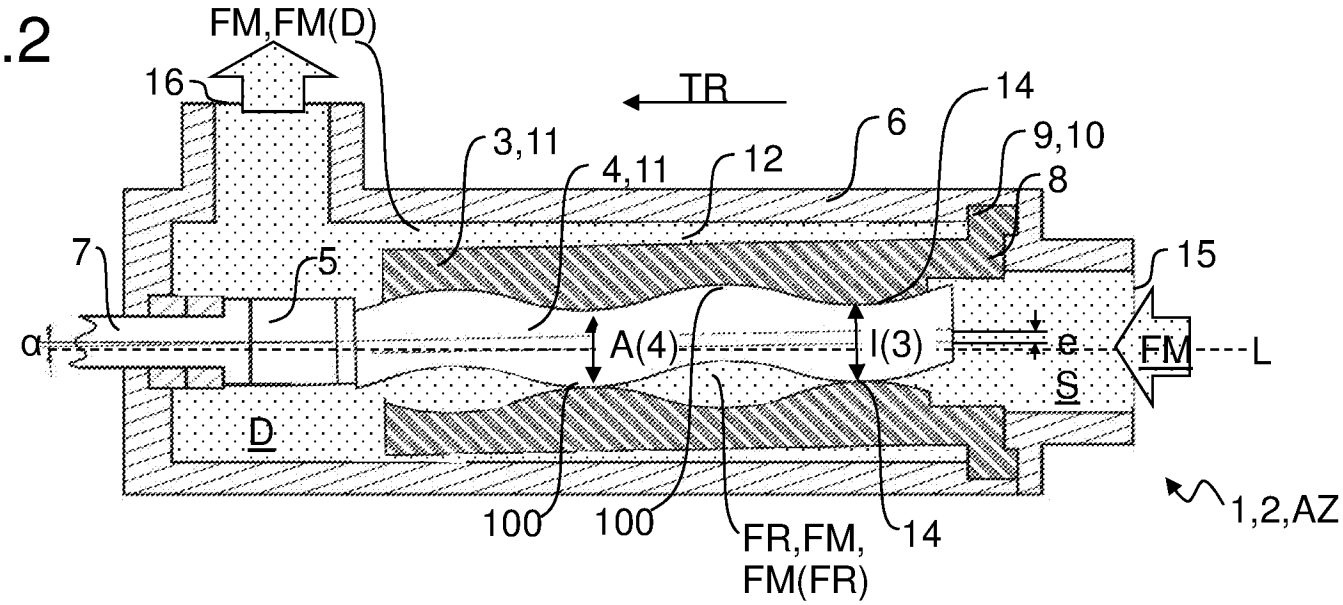
FIG. 2 shows an eccentric screw pump according to the invention in an operating state.

FIG. 1 shows a schematic view of an eccentric screw pump 1, in particular of a wobble pump 2, in an idle state, and FIG. 2 shows the eccentric screw pump 1 in an operating state AZ. The eccentric screw pump 1 comprises an elastomeric stator 3 comprising a helically coiled inner side and a rotor 4. The stator 3 has one more thread pitch than the rotor 4. The rotor 4 is accommodated in the stator 3. The rotor 4 and the stator 3 form the rotor-stator system 11. The rotor-stator system 11 is arranged in the pump housing 6, wherein an annular chamber 12 is formed between the pump housing 6 and the outer jacket surface of the stator 3.

The rotor 4 is coupled to the drive shaft 7 of a drive 30 (FIG. 15), for example of an electric motor, and performs a rotation around the longitudinal stator axis or around the longitudinal axis L, respectively, of the eccentric screw pump 1, and simultaneously a circular translation determined by the eccentricity e of the rotor-stator system 11. This means that the rotor 4 moves eccentrically in the stator 3.

The rotor 4 is coupled to the drive shaft 7 via a cardan joint 5. The eccentric movement of eccentricity e, respectively, between rotor 4 and stator 3 is compensated by means of torque transmission by means of the cardan joint 5. On the free end 8, which is located opposite the cardan joint 5, the stator 3 is secured to the pump housing 6 of the eccentric screw pump 1 on one side, in particular flexibly clamped. This allows for a further cardanic degree of freedom. The eccentricity e can be compensated by means of the distance of these two cardanic degrees of freedom, each having angle $\alpha$. The axis of the stator essentially describes a cone shape during production.

For securing to the pump housing 6, the free end 8 of the stator 3 has, for example, an annular widening 9, which is held for example in a clamping manner on the pump housing 6. If applicable, the annular widening 9 can serve as flange 10, via which the stator 3 can be connected, for example screwed, to the pump housing 6.

Figure 15:
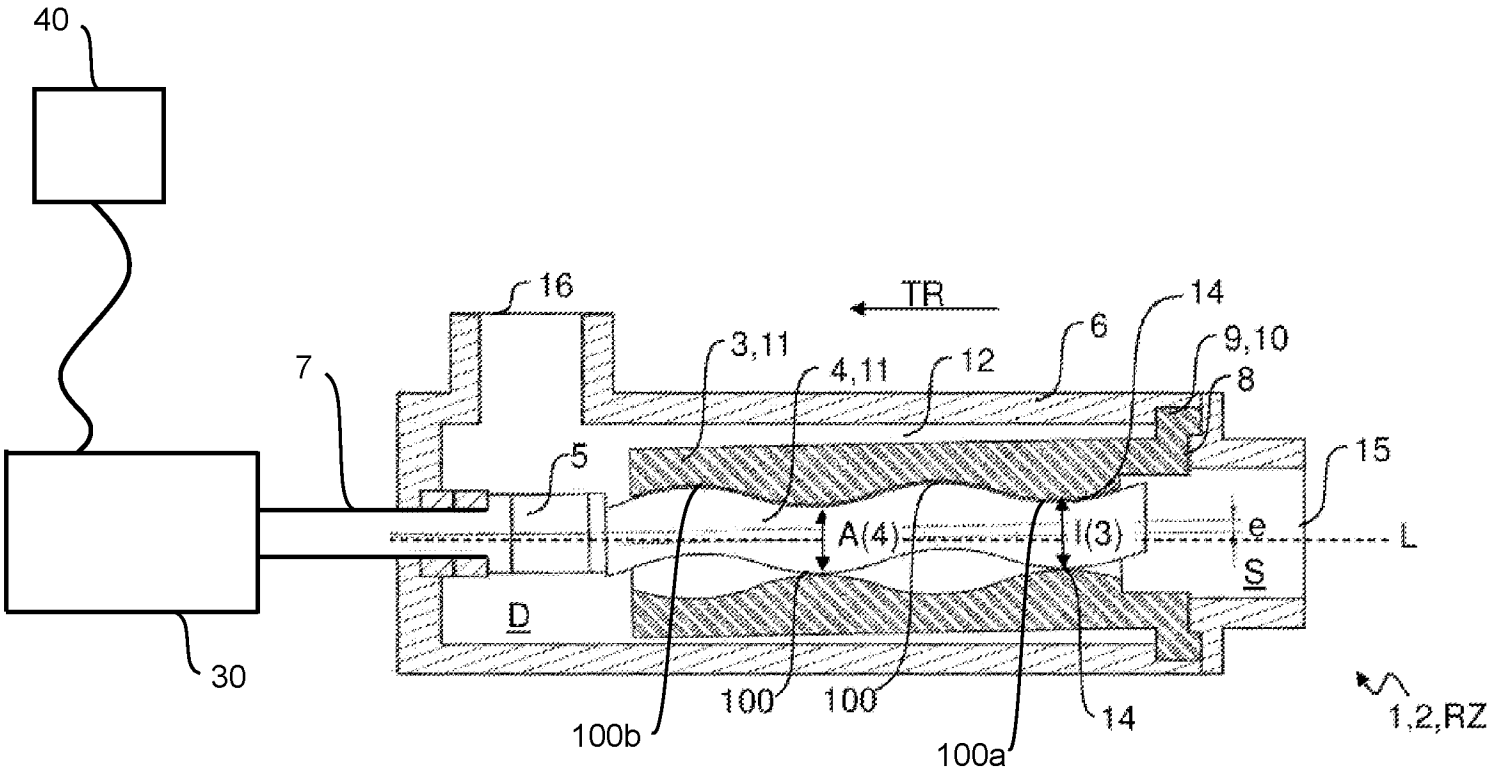
FIG. 15 shows the eccentric screw pump of FIG. 1 coupled to a drive shaft of a motor, which is depicted schematically.

The stator 3 and the rotor 4 are formed so as to be dimensioned in such a way that, in a first idle state RZ according to FIG. 1 of the eccentric screw pump 1, a play 100 or distance, respectively, is formed at least in some areas along the at least two sealing contact surfaces 14 between the rotor 4 and the stator 3. The rotor 4 in particular has dimensions A(4), which are smaller than the inner dimensions I(3) of the stator 3, at least in some areas. As shown in FIG. 15, a first play 100*a* is formed between the rotor and the wobble stator on the suction side S in the idle state of the wobble pump, and a second play 100*b* is formed between the rotor and the wobble stator on the pressure side D. The first play 100*a* on the suction side is in particular larger than the second play 100*b* on the pressure side.

Figure 3:
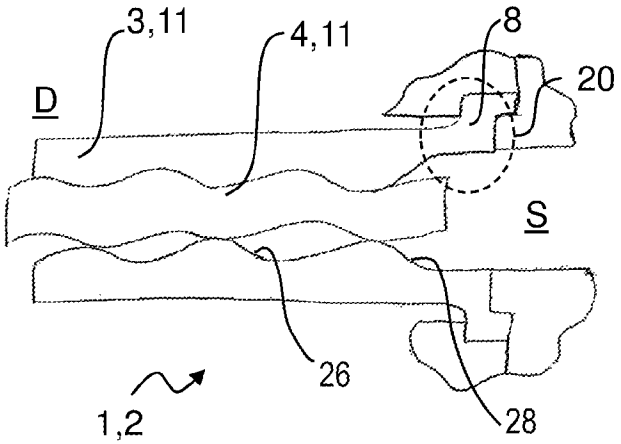
FIG. 3 shows a further illustration of an eccentric screw pump according to the invention in an operating state.

In the operating state AZ of the eccentric screw pump 1 according to FIG. 2, the conveying medium FM reaches via an inlet 15 into the eccentric screw pump 1 and is transported through the moving conveying chambers FR, which are formed from the movement of the rotor 4 and the mutual contact of stator 3 and rotor 4 on the sealing contact surfaces 14, from the suction side S to the pressure side D of the eccentric screw pump 1 in the conveying direction TR. The conveying medium FM is discharged from the eccentric screw pump 1 via the outlet 16 and is supplied to its further use or processing, respectively. As shown in FIG. 3, the rotor-stator system 11 has an inlet-side end portion, in which a sealing line-free inlet funnel 28 is formed between the stator 3 and the rotor 4 along a funnel length, wherein the screw thread-shaped inner circumferential surface 26 of the stator 3 is formed in a central main portion of the rotor-stator system and in the inlet-side end portion.

If conveying medium FM is pumped through the eccentric screw pump 1 (FIG. 2), the conveying medium FM effects a pressure, which is directed radially to the outside, onto the stator 3 in the conveying chambers FR formed between rotor 4 and stator 3, whereby the elastically deformable material of the stator 3 is pushed radially to the outside. To ensure a sufficient sealing of the conveying chambers RF, conventionally known wobble pumps have a coverage between the stator and the rotor in the idle state. This means that a prestress exists between the stator and the rotor. This prestress is attained in particular in that the outer dimensions of the rotor are larger than the inner dimensions of the elastomeric stator.

In the case of the illustrated eccentric screw pump 1 in the form of a wobble pump 2, the pressure of the conveying medium FM(FR) located within the conveying chambers FR is counteracted in the operating state AZ via the conveying medium FM(D), which has already been conveyed to the pressure side D. The conveying medium FM(D), which has the pressure side pressure, in particular flushes around the stator 3, which protrudes into the pressure side area D, and thereby pushes the stator 3 against the rotor 4. Due to the play 100 formed between the stator 3 and the rotor 4 in the idle state RZ, the start-up of the eccentric screw pump 1 can take place without the disadvantageously large starting torque of wobble pumps with coverage formed between rotor and stator in the idle state. The conveying effect can then always start with a very low value, and can be increased with the increase of the conveying medium FM(D), which is conveyed through the eccentric pump 1.

Due to the pressure exerted by the conveying medium FM(D) on the stator 3, the latter is in particular pressed against the rotor 4 in the area of the at least two sealing contact surfaces 14, whereby the individual conveying chambers FR are spatially separated from one another in a reliable manner. Due to the solid body contact between the rotor 4 and the stator 3 formed in the operating state AZ, a real separation of the conveying chambers FR as well as a separation between the suction side S of the eccentric screw pump 1 and the pressure side D of the eccentric screw pump 1 is attained.

A significant advantage of such an eccentric screw pump 1 or wobble pump 2, respectively, is in particular that a smaller expenditure of force is necessary to overcome the breakaway torque when transferring the eccentric screw pump 1 from a standstill or from the idle state RZ, respectively, into an operating state AZ, due to the play 100 formed at least in some areas between the rotor 4 and the stator 3 during start-up of the eccentric pump 1.

Figure 4:
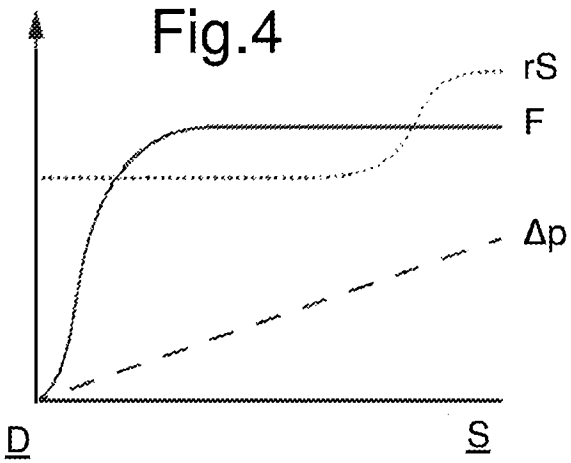
FIG. 4 shows the forces acting on the eccentric screw pump in the operating state.

FIG. 3 shows a further stylized illustration of an eccentric screw pump 1 according to the invention, and FIG. 4 shows the forces acting on the eccentric screw pump 1 in the operating state AZ. The flexible area 20 of the stator 3 on the free end area 8 is identified in FIG. 3. Due to the play 100 formed between rotor 4 and stator 3 in the idle state RZ (see FIG. 1), the rotor-stator system 11 does not have a prestress in the idle state RZ. During start-up of the eccentric screw pump 1, the starting torque is thus approximately zero and the operating torque is also small in the case of small differential pressures between the suction side S and the pressure side D. Said starting torque increases to the pressure side pressure p(D) as the conveying quantity increases. In the case of higher torque loads due to the increasing differential pressure between the suction side S and the pressure side D, the flexible area 20 of the stator 3 has a correspondingly higher prestress.

Due to the fact that the stator 3 is secured to the pump housing 6 only on one side, the ability to move of the stator 3 is only limited on one side. When calculating the pressing force F as a function of differential pressure $\Delta\rho$ and radial stability rS, a largely even pressing of the stator 3 against the rotor 4 results between pressure side D and suction side S.

Due to the play 100 formed between rotor 4 and stator 3 in the idle state RZ (see in particular FIGS. 1 and 2), only small oscillations are created, so that a wobble pump 2 comprising a correspondingly formed rotor-stator system 11 can be operated at higher speeds than conventionally known wobble pumps. Due to the play formed in the idle state RZ, in particular fewer excitations of the system, which is able to oscillate, result in the rotational direction. Wobble stators 3 according to the invention can thus be used in an advantageous manner in the case of speed-variable eccentric screw pumps 1 with predetermined power, for example solar-operated wobble pumps 2, in the case of which only lower differential pressures $\Delta\rho$ can usually still be overcome at higher speeds. As shown in FIG. 15, the solar-operated wobble pump 2 is driven by a drive 30 that is powered by a solar module 40, for example a solar or photovoltaic panel.

Figure 6:
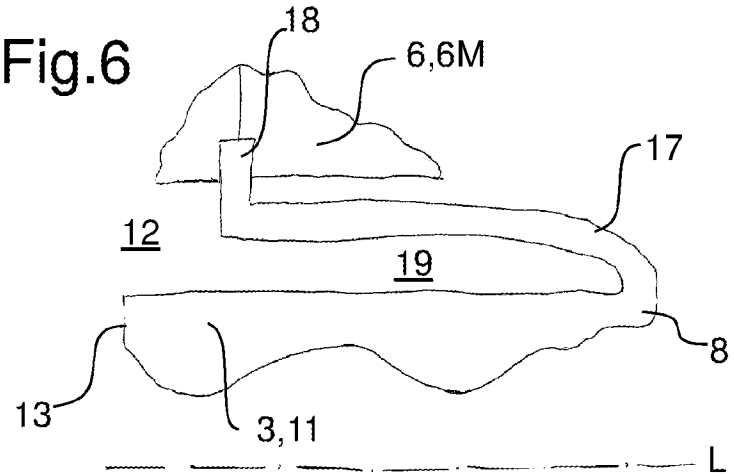
FIG. 6 shows a second embodiment of an end-side fastening of the stator of an eccentric screw pump.
Figure 5:
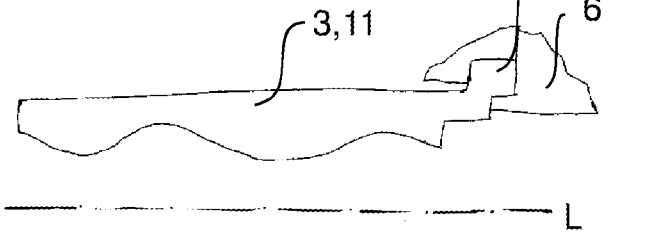
FIG. 5 shows a first embodiment of an end-side fastening of the stator of an eccentric screw pump.

FIG. 5 shows a first embodiment of an end-side fastening of the stator 3 of an eccentric screw pump 1, and FIG. 6 shows a second embodiment of an end-side fastening of a stator 3 of an eccentric screw pump 1. According to the embodiment illustrated in FIG. 5, the stator 3 has an annular widening 9 on its free end area 8, via which the stator 3 is secured to the pump housing 6. The annular widening 9 serves for example as flange 10 in order to screw the stator 3 to the pump housing 6 or the like.

According to the embodiment illustrated in FIG. 6, the stator 3 has, on its free end area 8, a flange structure 17, which extends in the direction of the opposite suction-side end area 13 and which encloses the stator 3 at least in some areas, wherein an annular chamber 19 is formed between the outer jacket surface of the stator 3 and the flange structure 17, which annular chamber is in fluidic connection with the above-described annular chamber 12, which is formed between the stator 3 and the pump housing 6. The flange structure 17, which extends in the direction of the opposite suction-side end area 13, merges into a free end area 18. The free end area 18 is secured to the pump housing 6, the stator 3 is in particular fastened to the pump housing 6 via the free end area 18 of the flange structure 17 in a central area 6M of said pump housing.

In the case of the two embodiments illustrated in FIGS. 5 and 6, the conveying medium FM can in each case flush largely completely around the stator 3 from the suction-side end area 8 to the pressure-side end area 13 (see in particular FIG. 2).

Figure 9:
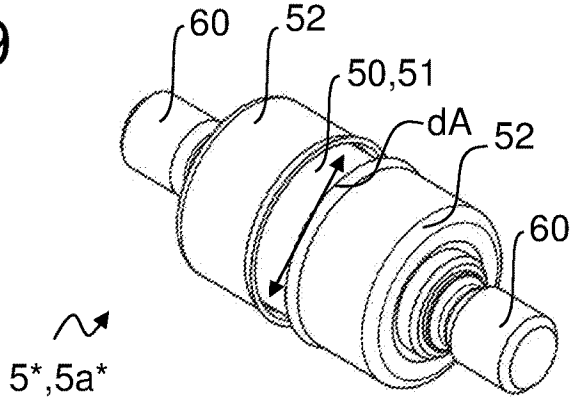
FIG. 9 shows a perspective illustration of an intermediate product during the production of the first embodiment of a joint according to FIG. 7.
Figure 10:
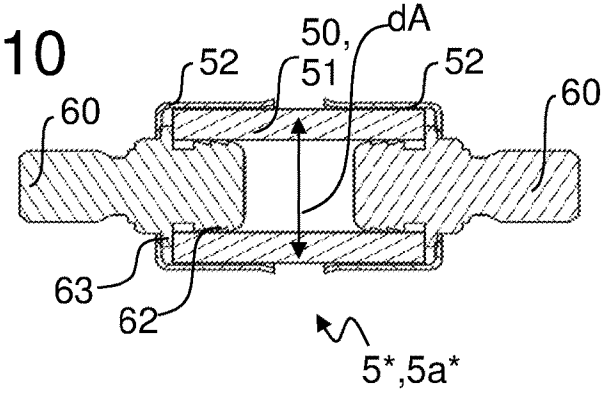
FIG. 10 shows a sectional illustration of the intermediate product during the production of the first embodiment of a joint according to FIG. 7.
Figure 11:
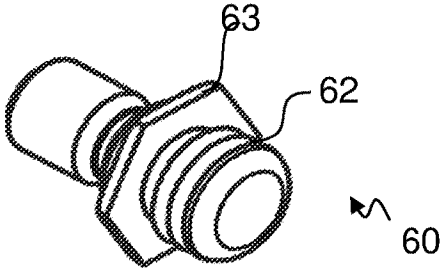
FIG. 11 shows a connecting piece of a joint according to FIG. 7.
Figure 7:
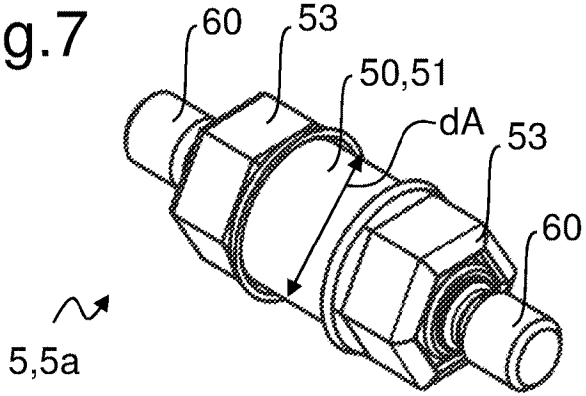
FIG. 7 shows a perspective illustration of a first embodiment of a joint.
Figure 8:
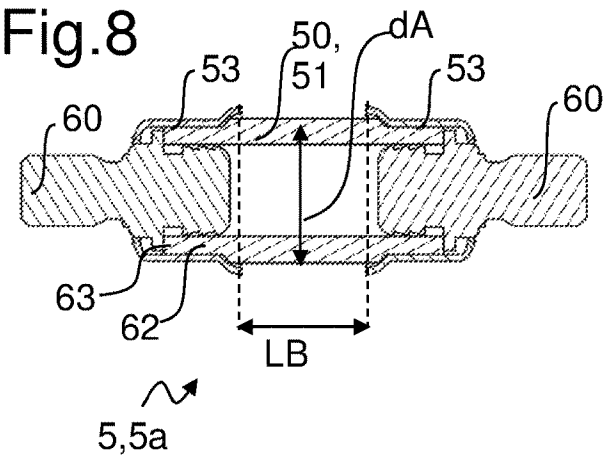
FIG. 8 shows a sectional illustration of the first embodiment of a joint according to FIG. 7.

FIG. 7 shows a perspective illustration of a first embodiment of a cardan joint 5, 5*a*, and FIG. 8 shows a sectional illustration. FIG. 9 shows a perspective illustration of an intermediate product 5*, 5*a during the production of the first embodiment of a cardan joint 5, 5***a* according to FIG. 7, and FIG. 10 shows a sectional illustration. FIG. 11 shows a connecting piece 60 of a joint 5, 5*a* according to FIG. 7.

The joint 5, 5*a* comprises an internally reinforced elastomer part 50. Tests have shown that between 0.5 and 1.5-times the outer diameter dA is already sufficient as free bending length LB in order to compensate an angular offset α of between 1° and 2°, which is common in wobble pumps 2. Fewer oscillations are created due to this short length of the joint 5, 5*a*, which also leads to an increased efficiency of the wobble pump 2, longer service life of the components of the wobble pump 2, and higher possible maximum speeds of the wobble pump 2.

For special embodiments, for example wobble pumps 2, which are subjected to particularly high stresses, the advantageous oscillation properties and the ability to transfer compressive forces of the short joint bodies 5, 5*a*, which are only stressed with angular deflection, can be combined with inner support bodies (not illustrated), which are known from the prior art. For example a ball, granulate, a helical spring, a cylindrical shaft piece or a flexible elastomer or plastic body, respectively, can thereby be used as inner support bodies. The combination of support body with a lubricant is recommended here. In addition, a more or less viscous supporting liquid can also be used.

The elastomer parts 50 of the joint 5*a* preferably consist of a commercially available hydraulic hose or another suitable hose comprising an inner reinforced structure. The inner reinforced structure can be formed, for example, by means of reinforcements, which are interlaced in a cross-shaped manner, in one or a plurality of layers. The reinforcement can thereby be made of metallic fibers or wires, plastic fibers and/or textile fibers or the like. A connecting piece 60 is in each case fastened to the two free ends of the hose piece 51, which forms the elastomer part 50. The two connecting pieces 60 are preferably formed with retaining grooves 62 in the axial direction and/or possibly also in the radial direction and possibly have further retaining means (not illustrated) for fastening and securing in and/or to the free end areas of the hose piece 51. The connecting pieces 60 preferably have an n-edged attachment area 63, whereby n corresponds to the number of the jaws of the subsequently used hose press (hose presses usually have six or eight jaws). The connecting piece 60 is in case assigned a sleeve 52 for retaining the respective end of the hose piece 51 (see FIGS. 9 and 10). The sleeves 52 are compressed with the help of a hose press, the sleeves 53 compressed in this sway (see FIGS. 7 and 8) in particular have, at least in some areas, an outer contour, which corresponds to the outer contour of the n-edge attachment area 63 of the respective connecting piece 60. The hose piece 51 is secured between the two connecting pieces 60 in this way. The n-edged area 63 on the connecting piece 60 is to thereby be oriented so as to be angular with the jaws of the hose press. After the pressing, a reliable connection is created between the respective connecting piece 60 and the respective sleeve 53, and thus also a reliable connection between the respective connecting piece 60 and the respective free end of the hose piece 51.

At least two sleeves 52 are preferably pressed simultaneously in a suitable jaw construction. A higher torque can be allowed for the construction by means the n-edged pressing between sleeve 52 and connecting piece 60, because a relative movement between the hose piece 51 and a sleeve 52 as well as between the hose piece 51 and the connecting piece 60, which is assigned to the sleeve 52, has to take place simultaneously for a slipping of the hose piece 51. The n-edged outer contour of the n-edged attachment area 63 can additionally be used as contact surface for tools, when for example detachable threads are used as connection to the adjacent parts, in particular the rotor 4 and/or the drive shaft 7 (see FIGS. 1 and 2). In the alternative, a cylindrical area, which is formed to be thin, can also be used instead of an n-edged outer contour of the connecting piece 60. In response to the pressing process, this thin area can then also be brought into the n-edged shape.

To protect the free ends of the hose piece 51, for example against environmental influences, such as penetrating fluid or the like, and/or to reinforce the bond between hose piece 51 and sleeves 52, 53 or hose piece 51 and connecting piece 60, respectively, a sealing and/or adhesive mass can additionally be used, which is introduced in particular between the free ends of the hose piece 51 and the respective sleeve 52, 53.

Figure 13:
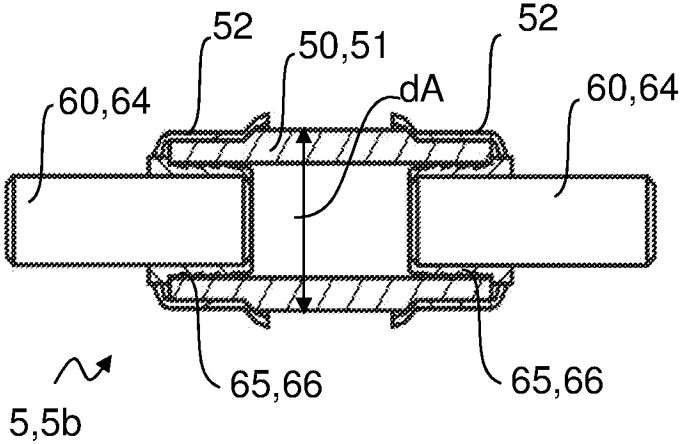
FIG. 13 shows a sectional illustration of the second embodiment of a joint according to FIG. 12.
Figure 14:
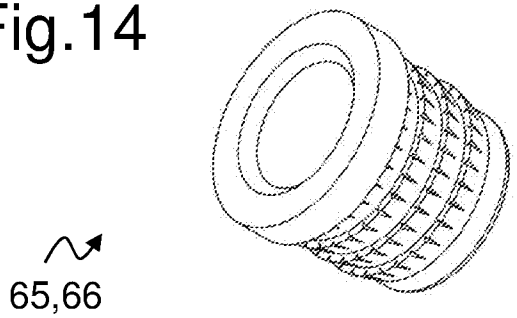
FIG. 14 shows a component of the second embodiment of a joint according to FIG. 12.
Figure 12:
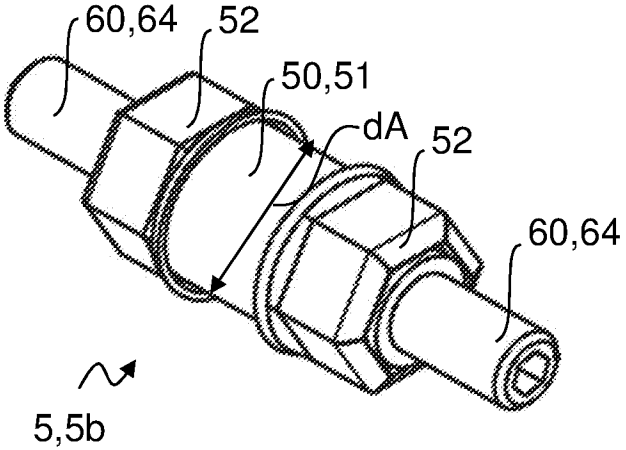
FIG. 12 shows a perspective illustration of a second embodiment of a joint.

FIG. 12 shows a perspective illustration of a second embodiment of a cardan joint 5, 5*b*, and FIG. 13 shows a sectional illustration. FIG. 14 shows a component 65 of the second embodiment of a cardan joint 5*b* according to FIG. 12. This embodiment provides to use a commercially available metallic insert for injection molded parts 66 as component 65. The n-edged connection between the connecting piece 60 and the pressed sleeve 52 can possibly be forgone here. In the illustrated exemplary embodiment, the connecting piece 60 is formed as threaded pin 64 comprising an internal thread for fastening to the rotor 4 and/or the drive shaft 7 (see FIGS. 1 and 2). In the alternative, threaded pins can be used, which provide external threads for fastening to the rotor 4 and/or the drive shaft 7.

The embodiments, examples and alternatives of the preceding paragraphs, the claims or the following description and the figures, including the various views thereof or respective individual features can be used independently of one another or in any combination. Features, which are descried in connection with an embodiment, can be applied to all embodiments, unless the features are incompatible. The invention has been described with reference to preferred embodiments. It is conceivable for a person of skill in the art that modifications or changes can be made to the invention, without thereby leaving the scope of protection of the following claims. It is possible to use some of the components or features of one of the examples in combination with features or components of another example.

The invention claimed is:

1. An eccentric screw pump for pumping a fluid or free-flowing conveying medium from a suction side to a pressure side, the eccentric screw pump comprising:

a rotor and a stator, wherein the stator is designed to be flexible and is secured to a pump housing on a suction side, wherein the rotor is connected to a drive shaft via a joint, wherein in an idle state of the eccentric screw pump, no sealing contact is formed at least in some areas between the rotor and the stator in sealing areas, wherein in an operating state of the eccentric screw pump, the stator is surrounded at least in some areas by the conveying medium, wherein the rotor and the stator are brought into contact along the sealing areas in the operating state by the conveying medium exerting pressure from outside the stator on an outer circumferential surface of the stator.

2. The eccentric screw pump according to claim 1, wherein a play is formed at least in some areas in the sealing areas between the rotor and the stator in the idle state.

3. The eccentric screw pump according to claim 2, wherein no sealing contact or a play, respectively, is formed between the rotor and the stator in the idle state in an area of between 50%-100% of the sealing areas, and wherein an overlap between the rotor and the stator is formed in the sealing areas in the operating state.

4. The eccentric screw pump according to claim 1, wherein no sealing contact or a play, respectively, is formed between the rotor and the stator in the idle state in an area of between 50%-100% of the sealing areas, and wherein an overlap between the rotor and the stator is formed in the sealing areas in the operating state.

5. The eccentric screw pump according to claim 1, wherein a first play is formed between the rotor and the stator in a first idle state of the eccentric screw pump on the suction side, and wherein a second play is formed between the rotor and the stator on the pressure side.

6. The eccentric screw pump according to claim 5, wherein the first play is formed to be larger than the second play.

7. The eccentric screw pump according to claim 6, wherein the play decreases continuously along the sealing areas between the rotor and the stator from the suction side of the eccentric screw pump to the pressure side of the eccentric screw pump.

8. The eccentric screw pump according to claim 5, wherein the play decreases continuously along the sealing areas between the rotor and the stator from the suction side of the eccentric screw pump to the pressure side of the eccentric screw pump.

9. The eccentric screw pump according to claim 1, wherein a play is formed between the rotor and the stator in a first idle state of the eccentric screw pump on the suction side, and wherein a coverage between the rotor and the stator is formed on the pressure side.

10. The eccentric screw pump according to claim 1, wherein the conveying medium, which at least partially surrounds the stator in the operating state, has the pressure side pressure.

11. The eccentric screw pump according to claim 1, wherein the stator is secured to the pump housing on one side directly via a free end area of the stator.

12. The eccentric screw pump according to claim 11, wherein, for securing to the pump housing, the free end area of the stator has an annular widening or wherein the free end area of the stator is formed as flange for securing to the pump housing.

13. The eccentric screw pump according to claim 1, wherein the joint has a central part, which is formed so as to be at least partially movable and which is made of a reinforced elastomer or plastic material.

14. The eccentric screw pump according to claim 13, wherein the reinforcement of the elastomer or plastic material is formed by a fiber reinforcement or wire reinforcement integrated in the material.

15. The eccentric screw pump according to claim 14, wherein the central part of the joint is limited on both sides by connecting pieces for fastening to at least one of the rotor or the drive shaft.

16. The eccentric screw pump according to claim 13, wherein the central part of the joint is limited on both sides by connecting pieces for fastening to at least one of the rotor or the drive shaft.

17. The eccentric screw pump according to claim 1, wherein the stator has a screw thread-shaped inner circumferential surface and includes an inlet funnel for the conveying medium on an end area of the stator, wherein the inlet funnel includes a continuation of the screw thread-shaped inner circumferential surface of the stator and is formed so as to be sealing line-free with respect to the rotor.

18. The eccentric screw pump according to claim 1, wherein at least one solar panel provides solar power to a drive for rotating the rotor.

19. The eccentric screw pump according to claim 1, wherein in the operating state of the eccentric screw pump, the stator is surrounded completely by the conveying medium.

* * * * *